US010852001B2

(12) United States Patent
Baird

(10) Patent No.: US 10,852,001 B2
(45) Date of Patent: Dec. 1, 2020

(54) ELECTRIC FIRE APPARATUS AND HEATING SYSTEM

(71) Applicant: Paul Christopher Baird, Tanworth-in-Arden (GB)

(72) Inventor: Paul Christopher Baird, Tanworth-in-Arden (GB)

( * ) Notice: Subject to any disclaimer, the term of this patent is extended or adjusted under 35 U.S.C. 154(b) by 0 days.

(21) Appl. No.: 16/304,989

(22) PCT Filed: May 22, 2017

(86) PCT No.: PCT/GB2017/051424
§ 371 (c)(1),
(2) Date: Nov. 27, 2018

(87) PCT Pub. No.: WO2017/203222
PCT Pub. Date: Nov. 30, 2017

(65) Prior Publication Data

US 2019/0293297 A1 Sep. 26, 2019

(30) Foreign Application Priority Data

May 27, 2016 (GB) ..... 1609556.4

(51) Int. Cl.
*F24C 7/00* (2006.01)
*G09F 19/16* (2006.01)

(52) U.S. Cl.
CPC ..... *F24C 7/004* (2013.01); *G09F 19/16* (2013.01)

(58) Field of Classification Search
CPC ..... F24C 7/004; F24C 3/006
(Continued)

(56) References Cited

U.S. PATENT DOCUMENTS 6,393,207 B1 * 5/2002 Martin ..... F24C 7/004 362/806
9,188,345 B1 * 11/2015 Lu ..... F24C 7/004
(Continued)

FOREIGN PATENT DOCUMENTS

CN 1922441 A 2/2007
CN 101256002 B 9/2008
(Continued)

OTHER PUBLICATIONS

Chinese Office Action in pending related application, and English translation.

(Continued)

*Primary Examiner* — Kristina N Junge
(74) *Attorney, Agent, or Firm* — Allen F. Bennett; Bennett Intellectual Property

(57) ABSTRACT

An electric fire apparatus (110) having an improved simulated flame effect comprising: an outer casing (112) having an at least in part light-transmissible ember bed base (116) therein; a projection screen (124) positioned in front of the ember bed base (116); a rotating spindle (136) positioned below the ember bed base (116); a light source (138) arranged to direct light towards the rotating spindle (136); and a mirror assembly which defines a reflection chamber adjacent to the rotating spindle (136), the mirror assembly having at least a forward-facing reflective surface (134) for directing light scattered from the rotating spindle (136) through the ember bed base (116) onto the projection screen (124). An electric heating system is also provided.

16 Claims, 7 Drawing Sheets

(58) Field of Classification Search
USPC ..... 40/428
See application file for complete search history.

(56) References Cited

U.S. PATENT DOCUMENTS

| | | | | |
|---|---|---|---|---|
| 2005/0252051 | A1* | 11/2005 | Chen | F24C 7/004 40/428 |
| 2007/0107280 | A1 | 5/2007 | Stinson et al. | |
| 2007/0175074 | A1 | 8/2007 | O'Neill | |
| 2009/0310340 | A1* | 12/2009 | Betz | F24C 7/004 362/183 |

FOREIGN PATENT DOCUMENTS

| | | | |
|---|---|---|---|
| EP | 0348137 | A2 | 12/1989 |
| EP | 1020685 | A2 | 7/2000 |
| EP | 1716367 | B1 | 11/2006 |
| GB | 249321 | A | 3/1926 |
| GB | 271189 | A | 5/1927 |
| GB | 272362 | A | 6/1927 |
| GB | 279285 | A | 10/1927 |
| GB | 282945 | A | 1/1928 |
| GB | 2298073 | A | 8/1996 |
| GB | 2356451 | B | 1/2003 |
| GB | 2377753 | A | 1/2003 |
| GB | 2411228 | A | 8/2005 |
| GB | 2488391 | A | 8/2012 |
| NZ | 546407 | A1 | 4/2007 |
| WO | 02077533 | A1 | 10/2002 |

OTHER PUBLICATIONS

Chinese Office Action in pending related application.
English translation of Chinese Office Action in pending related application.
European Patent Office Office Action.
United Kingdom Search Report in pending related application.

* cited by examiner

ELECTRIC FIRE APPARATUS AND HEATING SYSTEM

CROSS-REFERENCE TO RELATED APPLICATIONS

This application is a National Phase Utility Patent Application of PCT Application Serial No. PCT/GB2017/051424 filed on May 22, 2017 and claims priority to GB Application Serial No. GB 1609556.4 filed on May 27, 2016, the contents of which are hereby incorporated by reference.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to an electric fire apparatus, particularly but not necessarily exclusively for heating a room, which has an improved simulated flame effect. An electric heating system, having one or more satellite or peripheral heaters is also provided.

Description of the Related Art

Artificial electrically-powered fireplaces are known and accepted appliances. Light within the appliance causes artificial logs, coals or pebbles formed from wooden, ceramic, or other material, to provide an impression of a glowing-ember fire. With such existing devices, the flame effect is only at the back of the logs, coals, pebbles, or similar.

Such artificial fireplaces have advantages over real fires. They are perceived to be safer, more energy efficient, easy to operate and control, to be clean and reliable, and low maintenance levels are required. Such appliances are also considered as being environmentally-friendly, in that they do not result in the emission of carbon dioxide or dust or ash. They do not have adverse insurance implications, and can be manufactured and sold in many countries under various regulatory authorities.

Unfortunately, such artificial fireplaces do not produce realistic simulated flames. The effects are generally produced using rotatable reflective spindles, also called rotisseries, which illuminate a false flame outline on the fireplace. This produces a repetitive flickering effect, which is very different to the randomised natural illumination effect which is generated by real fuel in a real fire.

BRIEF SUMMARY OF THE INVENTION

The present invention seeks to provide an artificial electrically powered fire or heater with a simulated realistic flame picture giving the impression of a convincing deep burning fire which features a more natural hot ember bed with flames in front of the simulated fuel bed, within the fuel bed and to the rear of the fuel bed.

According to a first aspect of the invention, there is provided an electric fire apparatus having an improved simulated flame effect, the apparatus comprising: an outer casing having an at least in part light-transmissible ember bed base therein; a projection screen positioned in front of the ember bed base; a rotating spindle positioned below the ember bed base; a light source arranged to direct light towards the rotating spindle; and a mirror assembly which defines a reflection chamber adjacent to the rotating spindle, the mirror assembly having at least a forward-facing reflective surface for directing light scattered from the rotating spindle through the ember bed base onto the projection screen.

By co-ordinating the mirror assembly below the ember bed base of the apparatus, it becomes possible to direct the scattered light into regions of the apparatus which will create the illusion of depth to the flame effect. This can be advantageously achieved by the use of a projection screen onto which light effects can be produced at a front of the apparatus, which significantly improves upon prior backlit arrangements.

Preferably, the projection screen may be at least in part holographic. In this case, the projection screen may comprise a light-transmissible pane having a holographic layer thereon which is illuminable by the light scattered through the ember bed base.

The provision of a holographic element on the projection screen improves the realism of the flame effect projected thereon from the mirror assembly. Such an arrangement may produce, for example, a more realistic flame appearance, or could simulate sparking from the fuel, creating an improved aesthetic for the apparatus.

Optionally, the projection screen may comprise an upper transparent portion and a lower translucent portion which at least in part in use occludes the ember bed base from view.

The projection screen can beneficially also be used to hide any joins or visible apertures which might be present in the ember bed base or a display fuel thereon which would otherwise detract from the realism of the flame effect. By only masking a portion of the projection screen, the overall flame appearance is not impaired.

The apparatus may further comprise a front screen which is positioned at a front face of the outer casing, a base of the front screen being spaced apart from a base of the projection screen to define a gap which is communicable with the reflection chamber, wherein light scattered from the mirror assembly is directable through the gap. Preferably, the gap may have a depth of at least 8 millimetres.

The provision of a gap between a front screen and the projection screen can allow for a light channel to be formed which can allow light to escape from the mirror assembly in front of the projection screen. This can further improve the randomised appearance of the flame effect, which is more in keeping with a real flame effect.

In one embodiment, the reflection chamber may be open to a rear volume of the apparatus.

It is important to maintain a good circulation of air through electric fire apparatuses in order to limit the risk of failure, particularly of electronic components. Opening of the reflection chamber ensures that there is a viable airflow path through the apparatus.

The ember bed base may include a plurality of transparent apertures through which light from the mirror assembly is transmissible. Each of the plurality of apertures may have a width of less than 2 millimetres.

Transparent or otherwise light-transmissible apertures can alter the appearance of light scattered through the ember bed body, further improving the realism of the flame effect produced.

Preferably, the apparatus may further comprise a rear screen having a light-transmissible flame image thereon, and a rear lighting assembly, the rear lighting assembly being arranged to project light through the rear screen towards a front of the apparatus. The apparatus may further comprise an at least in part reflective screen positioned at or adjacent to a rear of the ember bed base.

The more screens provided for the apparatus, the more opportunity there will be to give an overall impression of depth to the flame effect produced.

Optionally, the mirror assembly may comprise a first, rear-facing mirror which defines a rear-facing reflective surface, and a second, front-facing mirror which defines the forward-facing reflective surface, the first and second mirrors being connected to one another at an angle, in which case the first mirror may at least in part overlap the ember bed base in a vertical direction. Alternatively, the mirror assembly may comprise an arcuate mirror element at least the forward-facing reflective surface.

The provision of paired or curved mirrors below the ember bed body allows for light to be scattered so as to hit both the front and back of the fire box area above the ember bed base. This can further improve the appearance of depth of the flame effect. Furthermore, the overlapping of a mirror with the ember bed base can also serve to obscure any unrealistic elements thereon.

According to a second aspect of the invention, there is provided an electric fire apparatus having an improved simulated flame effect, the apparatus comprising: an outer casing having an at least in part light-transmissible ember bed base therein; a projection screen positioned in front of the ember bed base; and an illumination assembly which defines a reflection chamber below the ember bed base, the illumination assembly having at least a forward-facing light-directing surface for directing light through the ember bed base onto the projection screen.

Whilst present apparatuses are able to utilise rotating spindle solutions in order to produce a flickering flame effect, it may well be possible to provide other flickering sources of illumination which could replicate the effect effectively. One possible advantageous solution might be in the use of LED, LCD and/or other kinds of light-emitting screens which can emit flickering light onto at least the projection screen of the apparatus.

According to a third aspect of the invention, there is provided an electric heating system comprising: a primary electric fire apparatus; at least one secondary electric heater apparatus which is remote to the primary electric fire apparatus; and a controller which is communicable with the primary electric fire apparatus and the or each secondary electric heater apparatus, the primary electric fire apparatus and the or each secondary electric heater apparatus being simultaneously activatable and deactivatable by the controller.

Preferably, the primary electric fire apparatus may be an electric fire apparatus in accordance with the first or second aspect of the invention. Optionally, the primary electric fire apparatus may have a greater thermal output than the or each secondary electric heater apparatus.

The provision of a first electric fire apparatus, ideally having a simulated flame appearance, is able to provide general heating for a room. However, for larger rooms, it may be impractical to scale a single apparatus to the size required in order to provide a sufficiently large thermal output. In this scenario, it is advantageous to have one or more satellite heaters which can be used to provide supplemental heating in the room, without detracting from the overall appearance of the room being apparently heated by the one apparatus which resembles a real fireplace.

BRIEF DESCRIPTION OF THE DRAWINGS

The invention will now be more particularly described, by way of example only, with reference to the accompanying drawings, in which.

DETAILED DESCRIPTION

Figure 1B:
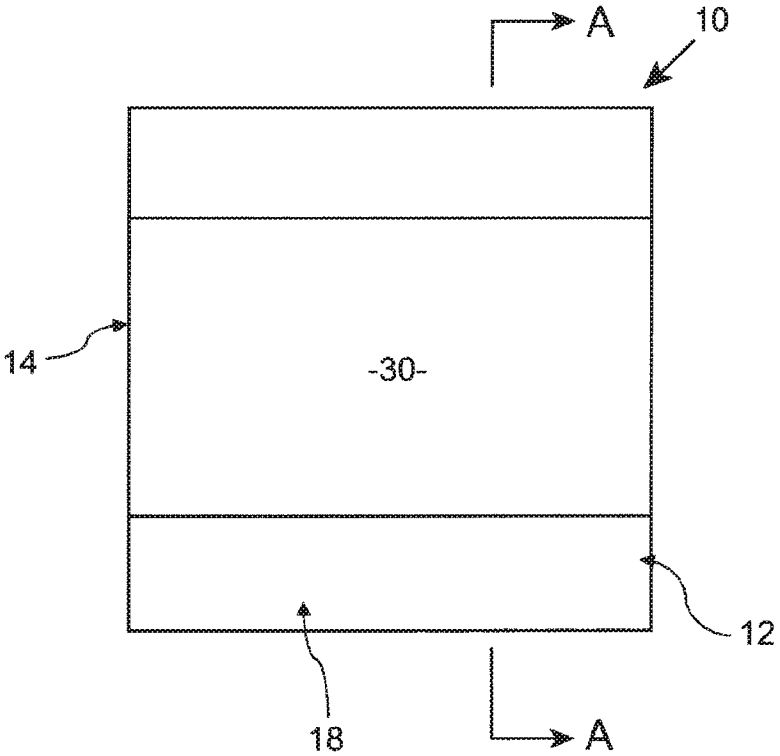
FIG. 1*b* shows a front representation of the electric fire apparatus of FIG. 1*a* in a deactivated condition.
Figure 1A:
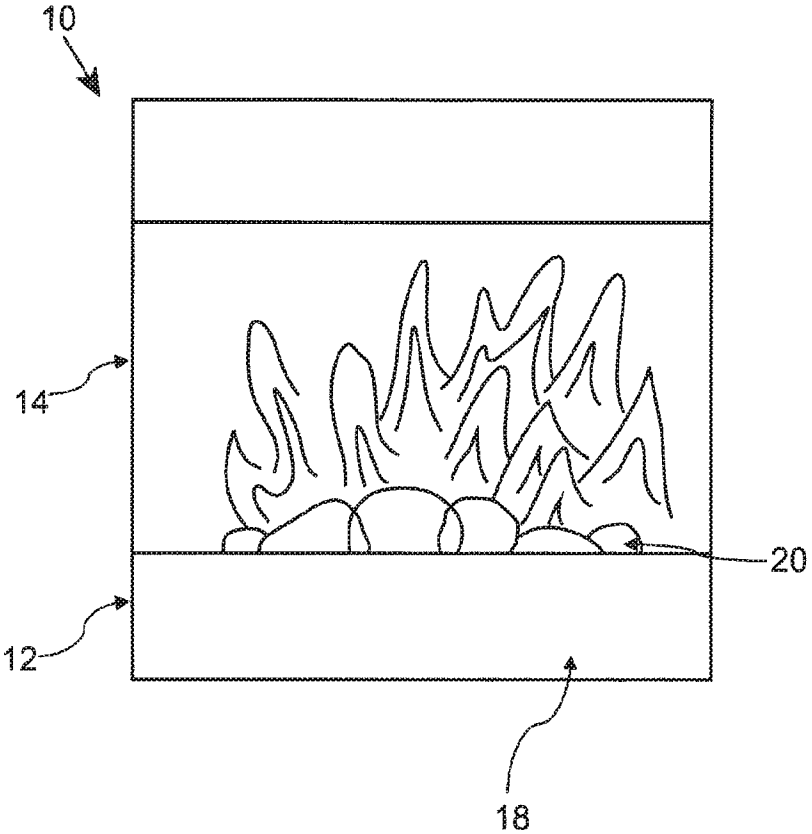
FIG. 1*a* shows a front representation of a first embodiment of an electric fire apparatus in accordance with the first aspect of the invention, shown in an activated condition.
Figure 2B:
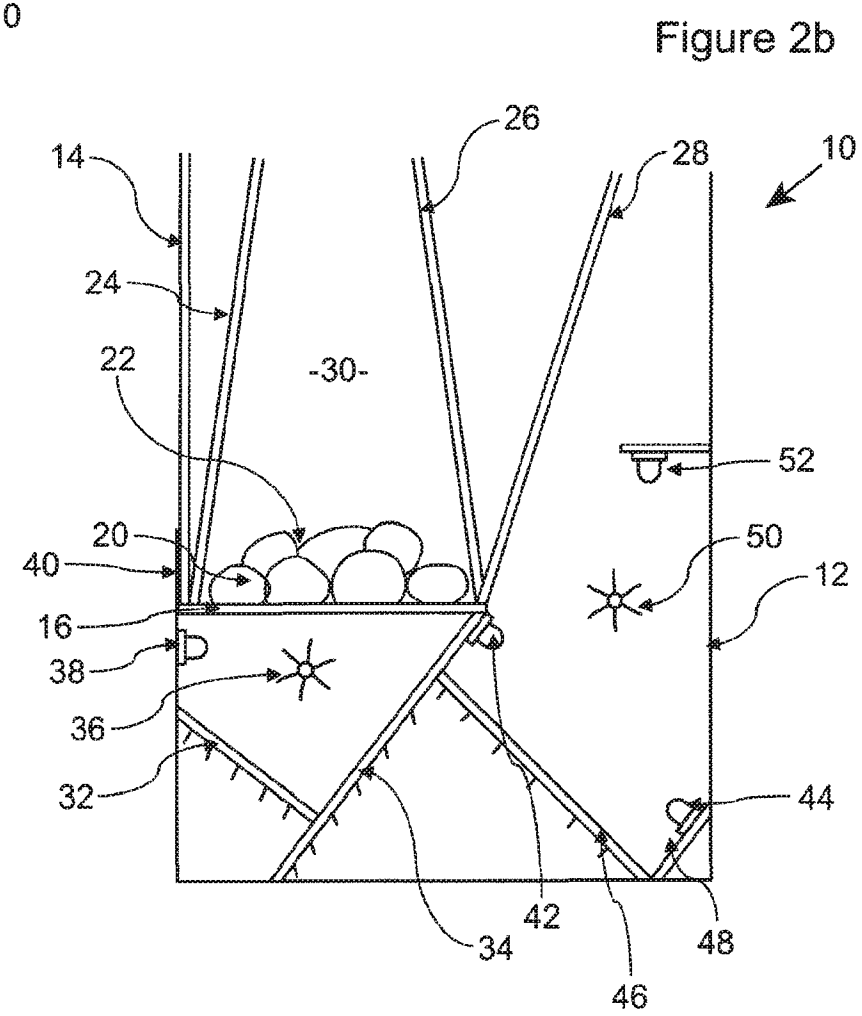
FIG. 2*b* shows an enlarged central cross-sectional representation through the electric fire apparatus of FIG. 2*a*, as indicated by the dashed boxed region.
Figure 2A:
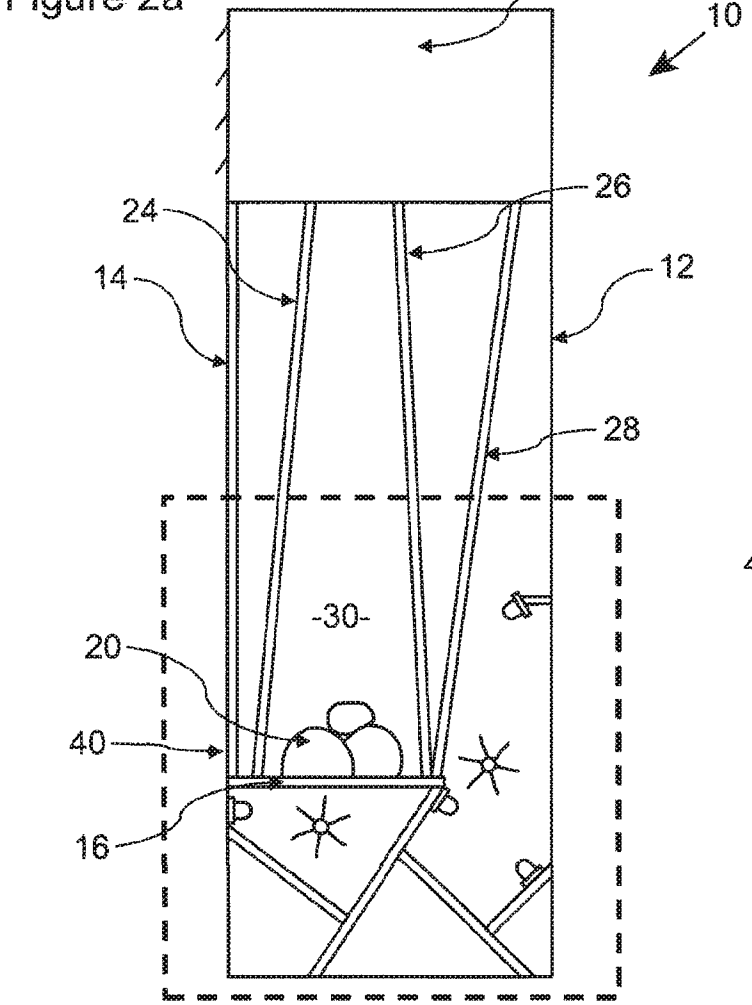
FIG. 2*a* shows a central cross-sectional representation through the plane defined by lines A-A through the electric fire apparatus in FIG. 1*b;*

Referring to FIG. 1*a* to 2*b*, there is shown an electric fire or simulated flame apparatus, indicated globally at 10, which includes an artificial fuel bed and integral fire appearance, which is sited in a rigid outer casing 12. The rigid outer casing 12 has a transparent, preferably glass, window or front screen 14 on a front face thereof to facilitate the viewing of the simulated fire and flame picture created by the electric fire apparatus 10. The electric fire apparatus 10 is shown in an activated condition in which the flame effect may be visible to a viewer.

There is provided an ember bed base 16 which is sited within a lower section 18 of the outer casing 12. Above the ember bed base 16 is the location in which display fuel 20 is located, often referred to as imitation fuel, such as coal or logs, or as a fuel bed. The type of display fuel 20 used can include, but is not limited to, imitation or real logs, coals, ceramics, pebbles, crystals and glass spheres. The material used will depend upon the desired visual effect to be created. Semi-transparent logs and/or coal may be provided which is hollow in nature having reflective strips therein which will reflect through the semi-transparent logs or coals to create a realistic burning effect; this in effect creates a reflective area 22 within the display fuel 20.

There may be provided four screens which are fitted vertically or substantially vertically within the outer casing 12 are which are attached to the ember bed base 16. A projection screen 24 may be provided, which may be formed as a 3D holographic rear projection screen, such as a polyethylene terephthalate (PET) nanoparticle 3D holographic rear projection screen. Here, the term rear projection screen refers to the fact that the holographic projection is on a rear side of the screen with respect to a front of the electric fire apparatus 10. The projection screen 24 is attached to the ember bed 16 and projects upwards towards the top of the appliance 10. The projection screen touches the front screen 14 at the ember bed base 16 and is here not perpendicular to the ember bed base 16, but is instead angled slightly rearwards with respect to a vertical plane extending upwardly from the base portion 16.

A, preferably coloured semi-translucent, rear screen 28, preferably having various levels or degrees of transparency is fitted at a rear of the ember bed 16 and is angled to the rear, as per the front screen 14.

A third, at least in part reflective screen 26, such as a two-way mirror or beam-splitter, is provided which adjoins the rear screen 28 at a level of the ember bed 16 and is then angled slightly forwards towards the front face of the outer casing 12. The angles of the front screen 14, rear screen 28 and reflective screen 26 are set so that the reflection creates a deep fire effect with no visible joins repeating in the reflection. Between the projection screen 24 and the reflective screen 26 is defined a main fire box area 30 in which the display fuel 20 or fuel bed is sited.

Below the ember bed 16, first and second mirrors 32, 34 are here fitted which are angled or curved to provide maximum light projection up through the ember bed 16 and fuel bed with no loss of light. These are used to provide a reflective chamber which preferably boxes in a front rotating spindle 36 and a front light source 38, which may be formed as one or more front LED spotlights, depending on a size of the display. Non-LED-based light sources, such as halogen bulbs, could be utilised, and it will be appreciated that the reflective chamber need not necessarily be fully enclosed.

The front rotating spindle 36 is provided as a rotating spindle having, preferably multi-coloured, foil reflectors. The spindle 36 rotates and its function is to reflect a moving beam of light from the front light source 38 up through the ember bed base 16 and up onto the rear projection screen 24. This will give the visual impression of flickering moving flames in front of the fuel 20. A more detailed depiction of this arrangement can be seen in FIG. 2*b*.

The light reflected by the front rotating spindle 36 will be reflected by first and second mirrors 32, 34, which are positioned at different angles relative to one another. This will create a flame effect within the fuel bed 20 and a glowing ember bed 16.

A mirrored strip 40, provided as a front reflection mirror strip, may be added to a base of the front screen 14 to reflect light back onto the projection screen 24. The overall effect will be one of a glowing fuel bed 20 with flames in front, within, and at the back of the fuel bed.

Within the fire box area 30 the image from the rear projection screen 24 and the reflections through the fuel bed 20 will be reflected in the reflective screen 26 creating a deep flame picture with flames from the front of the fuel bed 20 and through to the back of the fuel bed 20.

Additional rear light sources 42, 44, preferably formed as LED strip lights, may also be provided which reflect light off rear mirrors 46, 48, which may also be angled or curved, onto a rear rotating spindle 50 having foil reflectors, thereby creating a moving flickering light up onto the back of the rear screen 28. The light passes through reflective screen 26 and rear screen 28 into the fire box area 30 which adds more flames to the rear of the fuel bed 20. Preferably, the front and/or rear rotating spindles 36, 50 may have an axis of rotation which is in an in use horizontal plane.

An additional upper light source 52, preferably formed as one or more LED spot lights, depending on the size of the display, to increase the height of the flames, which increases the overall effect.

The electric fire apparatus 10 also includes a heater 54 which is sited at the top of the appliance.

The overall effect of this particular electric fire apparatus 10 is in the creation of a flame effect which has a much more natural appearance than that of existing apparatuses. This is achieved by providing a reflection chamber which directs light reflected off the front rotating spindle 36 in a plurality of different directions upwardly through the ember bed base 16 onto one or more of the screens positioned above which define the fire box area 30, and in particular onto the projection screen 24 above.

In the illustrated embodiment, the reflection chamber is provided as a region in which there is a mirror assembly which is capable of directing light from the front rotating spindle 36 in different directions up through the ember bed base 16. The mirror assembly is here formed by the first and second mirrors 32, 34 which are angled relative to one another so as to provide forward- and rear-facing reflective surfaces. It will be appreciated, however, that the same effect could be achieved by using a single curved mirror which cups or at least in part surrounds the front rotating spindle 36 from below. Preferably, there is provided at least a mirror which is behind the front rotating spindle 36, a mirror which is in front of the front rotating spindle 36, and also preferably a mirror which is below the front rotating spindle 36. Preferably, the mirror assembly overlaps with the front rotating spindle 36 at least in part in at least a vertical direction, and preferably overlaps with the front rotating spindle 36 at least in part in a horizontal direction.

A second embodiment of the electric fire apparatus is shown in FIGS. 3*a* to 8, indicated at 110. Identical or similar reference numerals with one hundred added will be used to refer to identical or similar components of the first embodiment described above, and further detailed description will be omitted for brevity.

Figure 3B:
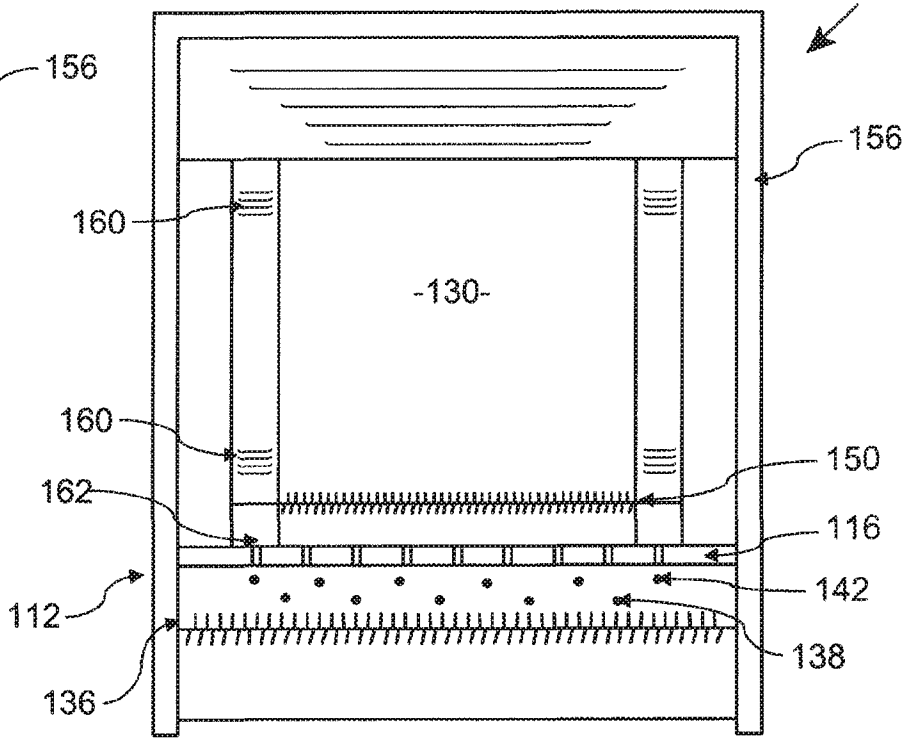
FIG. 3*b* shows a front representation of the electric fire apparatus of FIG. 3*a*, in a deactivated condition, with a front panel of the outer casing of the apparatus having been removed.
Figure 3A:
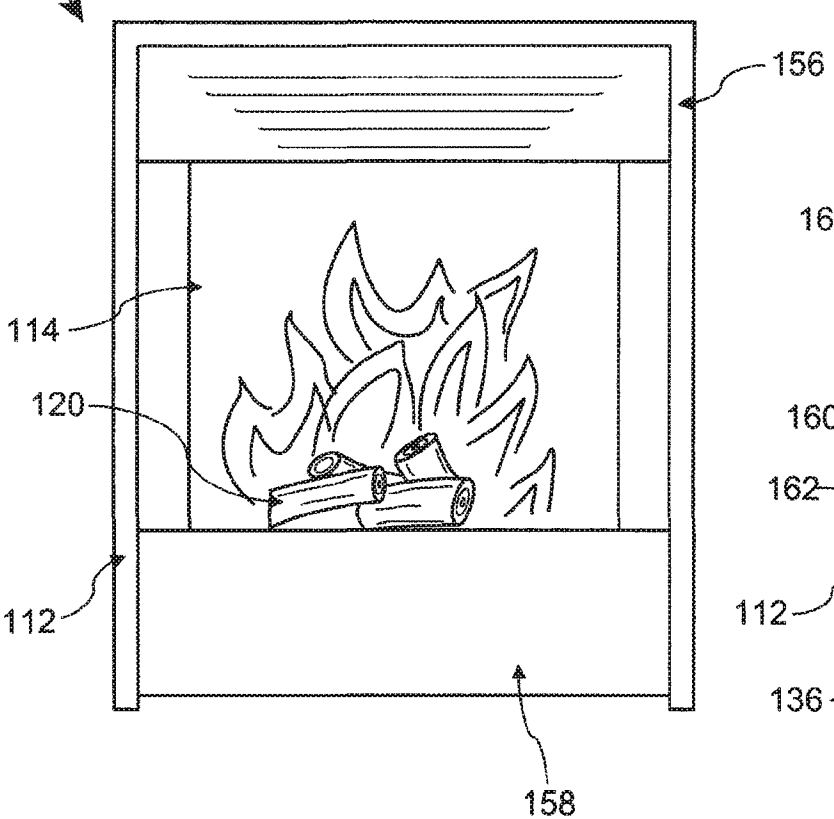
FIG. 3*a* shows a front representation of a second embodiment of an electric fire apparatus in accordance with the first aspect of the invention, shown in an activated condition.

The electric fire apparatus 110 comprises an outer casing 112, as can be seen in FIG. 3*a*, which provides a housing for the internal components of the apparatus 110. In particular, the outer casing 112 includes a casing body 156 which may comprise a plurality of individual panels which cover the top, bottom, rear and sides of the apparatus 110, and a front panel 158 which may at least in part support the front screen 114 of the apparatus 110. The front screen 114 defines a viewing area through which the fire box area 130 may be viewed from the front, such that the display fuel 120 and ember bed base 116 are visible to a viewer. An upper portion of the outer casing 112 may include one or more vents 160 through which heated air may be vented from a heater 154 of the apparatus 110; evidently, the heater could be positioned at any convenient position within the outer casing 112. The heater 154 may be dispensed with in certain situations, if the flame effect only is required for example. In this case, it may be beneficial to have a satellite or peripheral separate heater, as will be discussed hereinbelow.

The flame effect created by the apparatus 110 is also visible through the front screen 114, and appears to have a greater depth and more realistic appearance than equivalent prior art arrangements.

FIG. 3*b* shows the electric fire apparatus 110 with the front panel 158, and each of the front, projection, reflective and rear screens 114, 124, 126, 128 having been removed. The front rotating spindle 136 can be seen below the ember bed base 116, as well as the positioning of front and rear light sources 138, 142, which are here formed as LED strip lighting elements. The position of the rear rotating spindle 150 can also be seen, as can ventilation portions 160 of the outer casing 112 which are positioned on the side panels thereof to encourage airflow into a rear volume of the outer casing 112.

In this embodiment, the ember bed base 116 may be provided having a plurality of apertures 162 therethrough which provide light passages through the ember bed base 116 so as to improve the appearance of depth of the flame effect, particularly in relation to the glowing appearance of the display fuel 120. The apertures 162 are light-transmissible, and may be provided as open throughbores, or may contain light-transmissible material, such as glass or clear plastics material which is different to the material of the ember bed base 116, to achieve this end.

Figure 4:
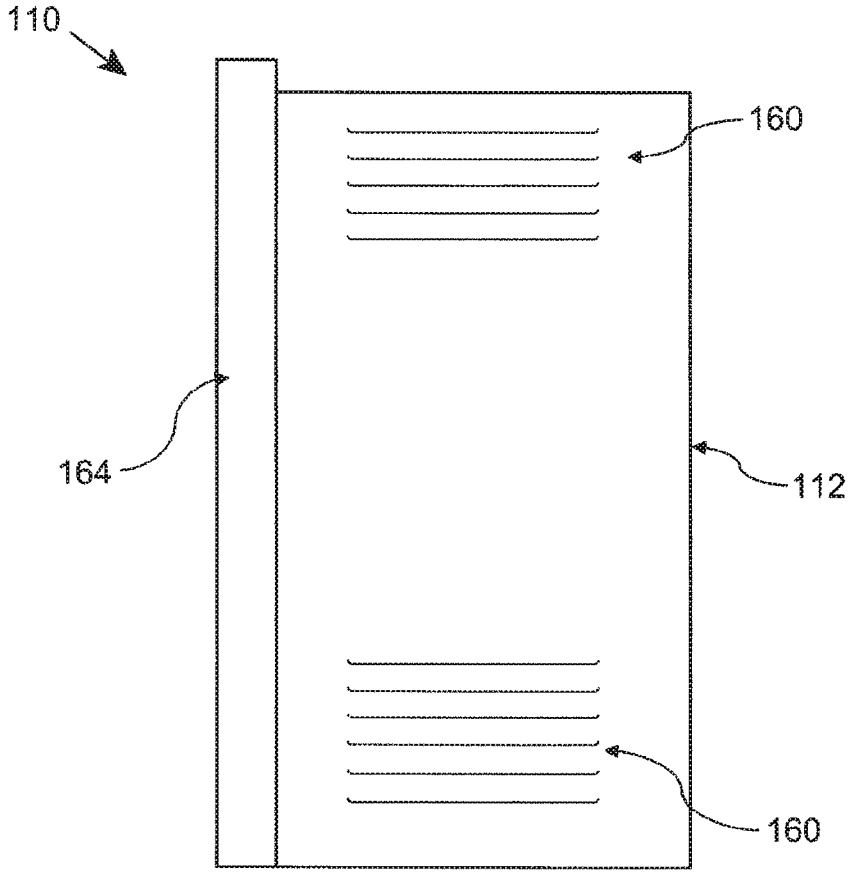
FIG. 4 shows a side representation of the electric fire apparatus of FIG. 3*a;*

The side of the outer casing 112 can be seen in more detail in FIG. 4, indicating the presence and positioning of the ventilation portions 162. The outer casing 112 may also be provided with a front trim 164 which may improve the aesthetic appearance of the electric fire apparatus 110. This may assist in matching the apparatus 110 to appear to more closely resemble a real fireplace, for example.

Figure 5:
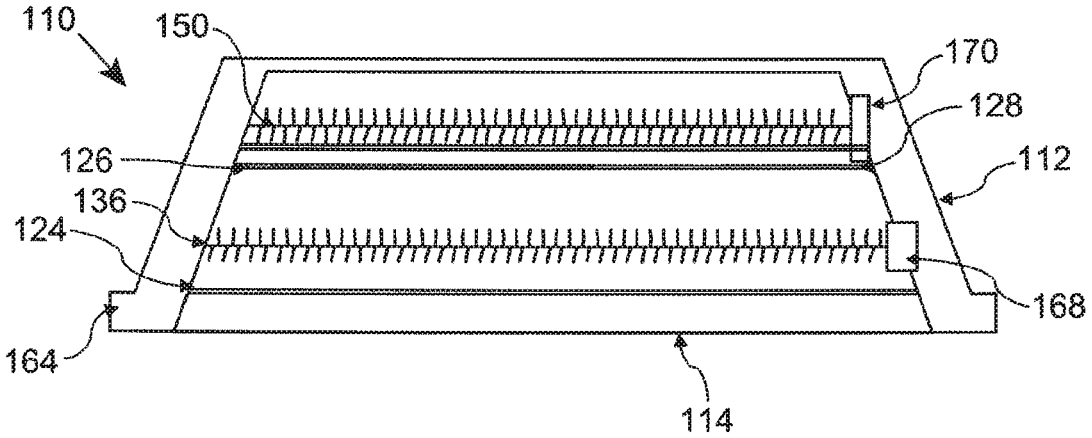
FIG. 5 shows a plan representation of the electric fire apparatus of FIG. 3*a*, with a top panel of the outer casing of the apparatus having been removed.

FIG. 5 shows a plan view through the apparatus 110, showing the relative positions of the front, projection, reflective and rear screens 114, 124, 126, 128 and the front and rear rotating spindles 136, 150. From front to rear, there is provided the front screen 114, which is preferably entirely transparent so as to give the appearance of the electric fire apparatus 110 being open, as if it were a real fireplace. The front screen 114 is preferably spaced apart from the projection screen 124, defining a front light channel 166 therebetween. It is noted that the front and projection screens 114, 124 do not necessarily need to be parallel to one another in order for a front light channel 166 to be defined. Preferably, the reflective screen 126 is formed as a pane having a half-silvered front and a frosted or diffuse back, therefore allowing light to pass through from the rear, but is reflected from the front.

The front rotating spindle 136 is then spaced rearwardly of the projection screen 124, noting that the front rotating spindle 136 is positioned below the ember bed base 116 in a vertical direction. A position of a drive motor 168 for the front rotating spindle 136 is indicated. It will be appreciated, however, that the positioning of the spindle 136 could be altered to be positioned towards, for example, the rear of the apparatus 110, with the scattered light being directed by a larger or more complex mirror assembly. It is noted that the relative positions of the front or rear rotating spindle 136, 150 with respect to the screens 114, 124, 126, 128 could readily be rearranged, depending upon an internal configuration of the apparatus 110. In particular, the positioning of the rear rotating spindle 150 could be altered significantly, both vertically and/or horizontally, with the use of mirrors to direct the scattered light as desired.

The fire box area 130 of the electric fire apparatus 110 is preferably defined between the projection screen 124 and the reflective screen 126, either or both of which could be angled out of a vertical plane, if this improved the appearance of the flame effect. It is noted that if one or more of the screens is removed however, then the fire box area 130 will be defined as the visible illuminated area above the ember bed base 116.

Continuing towards the rear of the electric fire apparatus 110, there is positioned the rear screen 128, which may be angled relative to the reflective screen 126. The rear rotating spindle 150 is then positioned behind the rear screen 128 to provide a flickering lighting effect through the rear screen 128; again, the position of a rear motor 170 associated with the rear rotating spindle 150 is illustrated.

Figure 6:
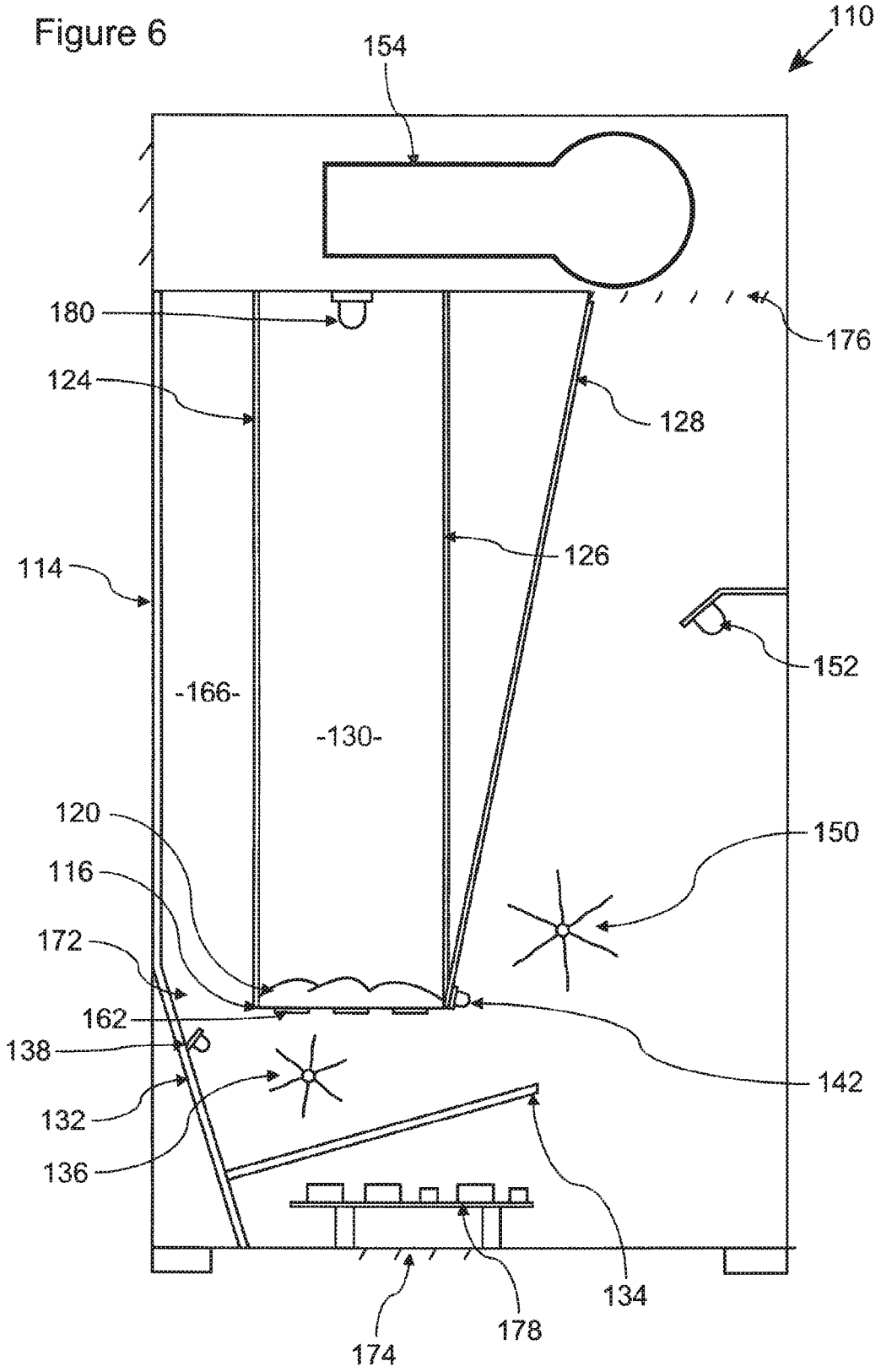
FIG. 6 shows a central cross-sectional representation through the electric fire apparatus shown in FIG. 3*a;*

FIG. 6 shows the internal components of the electric fire apparatus 110 inside the outer casing 112. As with the first embodiment described above, there is a reflection chamber which is defined by a mirror assembly below the ember bed base 116. The apertures 162 through the ember bed base 116 can be seen in the cross-section shown. Preferably, said apertures 162 have a width or diameter which is no greater than 2 millimetres.

The reflection chamber is here formed by first and second mirrors 132, 134 which are positioned at an angle to one another such that the first mirror 132 defines a rearward-facing reflective surface and the second mirror 134 defines a front-facing reflective surface, at least in general terms. This is not to say that each reflective surface is completely front- or rear-facing inside the reflection chamber, that is, the mirrors 132, 134 are not positioned so as to be parallel to the front and rear surfaces of the outer casing 112. The first and second mirrors 132, 134 are also positioned so as to partially deflect the scattered light upwardly through the ember bed base 116.

The reflection chamber is in the present embodiment preferably provided as an open chamber, that is, it is not fully enclosed from all directions, and therefore could be considered to be a reflection volume or region of the electric fire apparatus 110. In this instance, the first mirror 132 extends upwardly or substantially upwardly between the front screen 114 and the projection screen 124, through a gap 172 defined by a spacing between the front screen 114 and the projection screen 124. Reflected light can be scattered up through the gap 172 into the light channel 166, and this reflected light can add to the effect of depth of the flame appearance of the electric fire apparatus 110. Preferably, the gap 172 has a depth of at least 8 millimetres.

The first mirror 132 may preferably be positioned such that an upper edge thereof is vertically higher than the ember bed base 116, so as to at least in part occlude the ember bed base 116, and in particular any joins therein, from view. The or each front light source 138 may be mounted at or adjacent to the front mirror 132, preferably being directed towards the front rotating spindle 136. A baffle may also be provided to prevent light from the front light source 138 from being directed directly up the light channel 166 through the gap 172.

The second mirror 134 may preferably also be provided so as to not contact the ember bed base 116. In this arrangement, this can result in the reflection chamber being open to a rear volume of the outer casing 112. This may improve an airflow through the electric fire apparatus 110. A base ventilation port 174 may be provided on a base of the outer casing, and an inner ventilation port 176 may be provided at or adjacent to the heater 154, both of which may result in improved airflow through the electric fire apparatus 110, in turn reducing the likelihood of the electrical components overheating.

Electrical control components 178 may preferably be provided inside the outer casing 112, and in the depicted embodiment, these are provided as PCB-mounted electronics which are positioned below the second mirror 134. The PCB-mounted electronics may control the front and rear rotating spindles 136, 150 and any or all of the front light source 138, rear light source 142, upper rear light source 152 and top light source 180. It is noted that the electric fire apparatus 110 may be controlled manually or via remote control, and could include communication means to be able to communicate with a smart controller which is external to the apparatus and may be able to control one or more other appliances, such as other heaters.

In use, in either embodiment of the invention, but particularly described in respect of the second embodiment, the light sources 138, 142, 152, 180 and rotating spindles 136, 150 may be activated. Using the controller, one or more of the light sources 138, 142, 152, 180 and/or rotating spindles 136, 150 may be deactivated to create different effects or appearances. For example, front light source 138 may be separately and independently deactivated to create a smouldering flame effect, and this has been shown to be particularly effective in tests.

Figure 7:
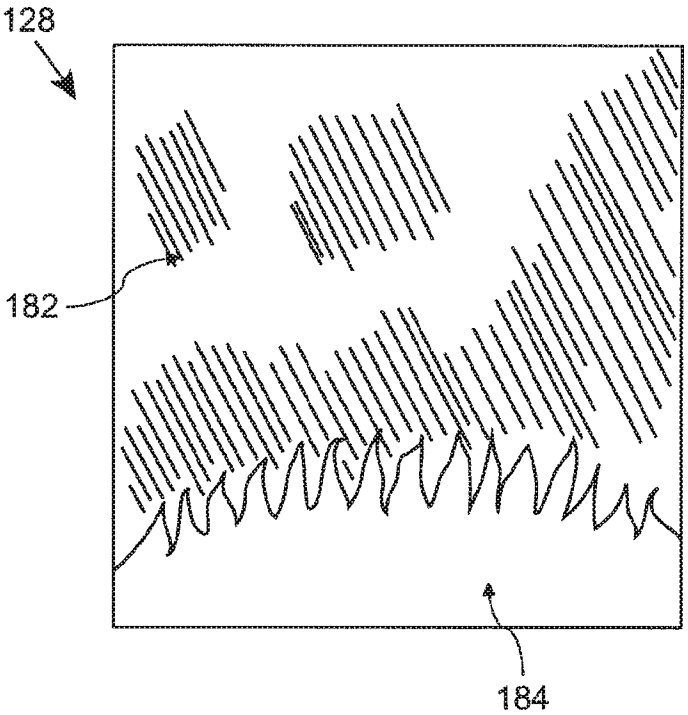
FIG. 7 shows one embodiment of a front view of a rear screen of the electric fire apparatus as shown in FIG. 3*a;*

The rear and upper rear light sources 142, 152 may direct light towards the rear rotating spindle 150, forming a rear lighting assembly, which scatters light in the direction of the rear screen 128. One embodiment of the rear screen 128 is shown in FIG. 7; the rear screen 128 includes an upper opaque portion 182 and a lower, preferably coloured, translucent portion 184 which is in the shape of a flame effect. The light directed through the rear screen 128 will pass through the reflective screen 126, which is light-transmissible from the rear, and into the fire box area 130. This will create the appearance of dancing or flickering flames inside the fire box area 130, with a realistic profile.

The upper light source 180 here directs light down through the fire box area 130, and may act as a spotlight on the display fuel 120 and/or ember bed base 116. In particular, some reflectivity of light from the display fuel and/or ember bed can be beneficial. This may improve the appearance of the glowing of the display fuel 120, for example.

The front light source 138 provides the lighting from underneath the ember bed base 116. Light is directed onto the front rotating spindle 136, which in turn is scattered up through the ember bed base 136, and may illuminate the reflective area inside the display fuel 120, if applicable.

The front rotating spindle 136 also scatters light onto the mirror assembly forming the reflective chamber. In this instance, light is scattered off the first, rear-facing mirror 132, through the ember bed base 116, and towards the at least in part reflective screen 126. The light can then be scattered off the reflective portion of the reflective screen 126 into the fire box area 130, giving the impression of flames towards the back of the fire box area 130.

Light may also be scattered off the second, front-facing mirror 134, through the ember bed base 116, and towards the projection screen 124. Where the projection screen 124 is provided with a holographic portion, such as a holographic layer which may comprise a flame effect image or similar, then light will be directed from the second mirror 134 and illuminate the projection screen 124. This gives the appearance of a flame effect towards the front of the electric fire apparatus 110.

It will be appreciated that, where a projection screen 124 is provided, the other screens could feasibly be dispensed with, particularly if a holographic portion is particularly realistic.

Figure 8:
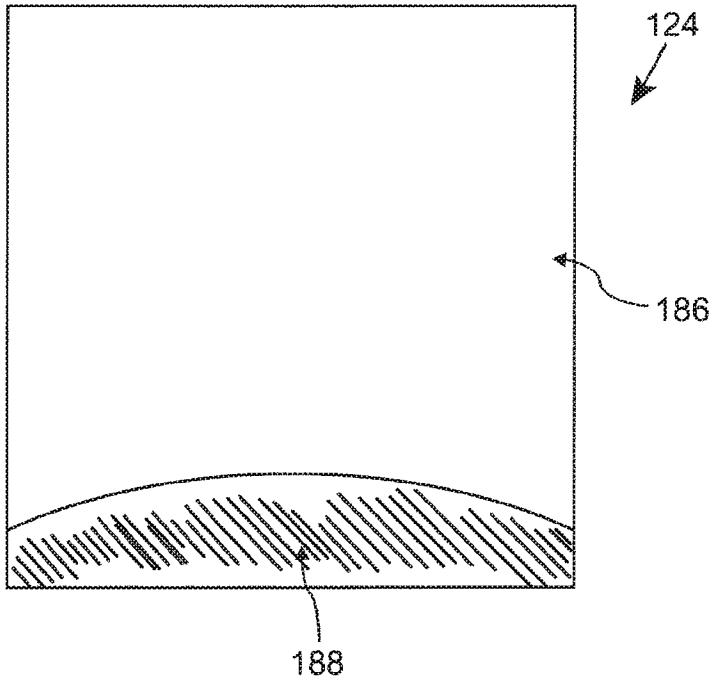
FIG. 8 shows one embodiment of a front view of a projection screen of the electric fire apparatus of FIG. 3*a*.

An indicative projection screen 124 used in the invention is shown in FIG. 8. The projection screen 124 comprises an upper transparent portion 186, and a lower diffuse or frosted portion 188, which may occlude or block from view any joins or imperfections of the ember bed base 116 as viewed from the front of the electric fire apparatus 110. The diffuse or frosted translucent portion 188 may be formed, for example, by forming the projection screen 124 from an acrylic, plastics material or glass, and then treating a portion thereof with a chemical to produce the frosting effect. An acid could achieve this result, or treatment with turpentine could also result in a similar effect.

In total, the appearance of depth in the flame effect can be achieved through multiple sources. Firstly, the ember bed base 116 will be illuminated, and the display fuel 120 may also be lit. Light can also be scattered off the reflective screen 126, and potentially off the inside of the front screen 114 via illumination up through the gap 172 and light channel 166. Most significantly, the mirror assembly is arranged so as to direct light onto the projection screen 124, which, if provided with a holographic portion, can give an appearance of a real, live and moving flame effect, which is considerably more realistic than those available at present.

Whilst the state of the art is such that light is scattered into the fire box area via a light source directed at a rotating spindle and mirror configuration, it is feasible that alternative arrangements which, for example, utilise light-emitting screens, such as LED, LCD and/or other kinds of light-emitting screens, could be used to create the flickering flame effect in a more realistic manner. Such a light-emitting assembly could be directed so as to illuminate a projection screen of the electric fire apparatus, achieving the same result as the above-described embodiments.

The electric fire apparatuses described above are suitable for providing heat to a room in a building. However, it will be appreciated that the thermal output of such electric devices may be limited by the size or power of the heater contained therein. Since the goal is to provide the appearance of the heat being produced from a simulated fire, it is generally undesirable to provide additional simulated fireplaces in the room.

Figure 9:
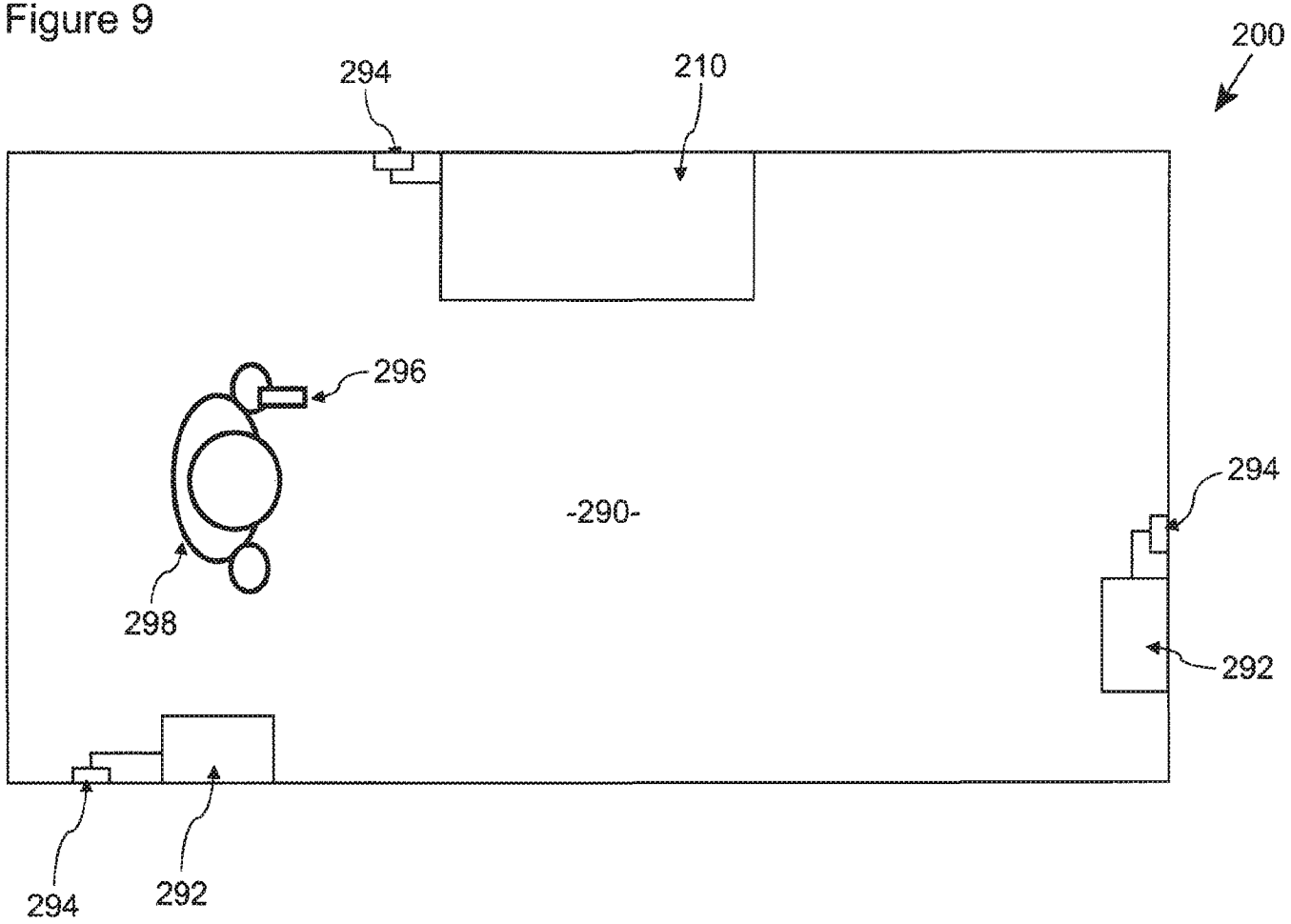
FIG. 9 shows a plan representation of a room having an electric heating system in accordance with the third aspect of the invention.

An embodiment of the invention is therefore illustrated in FIG. 9, indicating an electric heating system, indicated generally at 200. There is indicated a room 290 in a building, in which is installed an electric fire apparatus 210, preferably an apparatus as described above which is capable of producing a simulated flame effect. Identical or similar reference numerals will once again be used to refer to identical or similar components to those described above, and further detailed description is omitted for brevity.

In order to improve the heating in the room 290, one or more secondary or satellite heaters 292 may be provided which are electrically powered, for example, being connected to a mains electricity supply via a power socket 294. The satellite heaters 292 may be activated in order to increase the heating within the room 290, thereby supplementing the electric fire apparatus 210 without detracting from the overall appearance of the room 290.

The electric fire apparatus 210 may be controlled by a remote control 296, which may be activated by a user 298. The remote control 296 may be formed as a standard remote control unit, or could be part of a user device, such as a smart phone or tablet computer. The remote control 296 permits activation of the electric fire apparatus 210 simultaneously with the or each satellite heater 292, thereby allowing all of the heating required in the room 290 to be activated at once. This avoids the appearance of multiple heaters being activated independently, which would otherwise detract from the appearance of the electric fire apparatus 210 from seemingly providing all of the heat in the room.

It will be appreciated that the remote control 296 need not necessarily activate all satellite heaters simultaneously; the user 298 may be able to select a level of heating which is required for the room, and the remote control 296 could activate, preferably automatically, any or all satellite heaters 292 which may be required. To this end, it is preferred that the electric fire apparatus 210 have a greater thermal output than any of the individual satellite heater apparatuses 292.

The remote control 296 could be provided having an internal processor which attends to any command signals, and then may include a wireless transmitter which communicates the command signals to the primary electric fire apparatus 210 and the or each satellite heater 292. Alternatively, it may be possible to provide a dedicated controller and communications device onboard the electric fire apparatus 210. The remote control 296 may then be solely used to send activation or deactivation signals to the controller, and the communications device may then send signals on to the satellite heaters 292 such that all devices are simultaneously activated.

It may potentially be possible to provide sequential activation of the electric fire apparatus 210 and satellite heaters 292, for example, to correspond with detected changes in climatic conditions within the room 290. To this end, one or more temperature sensors could be provided in order to allow detection of the environmental conditions within the room 290, such as a thermostat or temperature gauge.

It is therefore possible to provide an electric fire apparatus which has an improved simulated flame appearance. This is achieved by the provision of a specialised mirror assembly below the ember bed base of the apparatus, which is able to direct a flickering light towards a projection screen at the front of the apparatus. This, coupled with the glowing effect produced by the ember bed base, as well as backlit projections of a flame effect, leads to a simulated flame which has a very realistic appearance.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. An electric fire apparatus having an improved simulated flame effect, the apparatus comprising:

an outer casing having an at least in part light-transmissible ember bed base therein;

a projection screen positioned at or adjacent to a front of the ember bed base;

a rotating spindle positioned below the ember bed base;

a light source arranged to direct light towards the rotating spindle;

a mirror assembly which defines a reflection chamber adjacent to the rotating spindle, the reflection chamber being below the ember bed base; the mirror assembly having at least a forward-facing reflective surface to direct light scattered from the rotating spindle through the ember bed base onto the projection screen; and a front light channel which is at a front of the projection screen and is adapted to light-transmissibly communicate with the reflection chamber.

2. An electric fire apparatus as claimed in claim 1, wherein the projection screen is at least in part holographic.

3. An electric fire apparatus as claimed in claim 2, wherein the projection screen comprises a light-transmissible pane having a holographic layer thereon to be illuminated by the light scattered through the ember bed base.

4. An electric fire apparatus as claimed in claim 1, wherein the projection screen comprises an upper transparent portion and a lower translucent portion which at least in part in use occludes the ember bed base from view.

5. An electric fire apparatus as claimed claim 1, further comprising a front screen which is positioned at a front face of the outer casing, a base of the front screen being spaced apart from a base of the projection screen to define a gap through which the front light channel is adapted to light-transmissibly communicate with the reflection chamber, wherein light scattered from the mirror assembly is directed through the gap.

6. An electric fire apparatus as claimed in claim 5, wherein the gap has a depth of at least 8 millimetres.

7. An electric fire apparatus as claimed in claim 1, wherein the reflection chamber is open to a rear volume of the apparatus.

8. An electric fire apparatus as claimed in claim 1, wherein the ember bed base includes a plurality of transparent apertures through which light from the mirror assembly is transmitted.

9. An electric fire apparatus as claimed in claim 8, wherein each of the plurality of apertures has a width of less than 2 millimetres.

10. An electric fire apparatus as claimed in claim 1, further comprising a rear screen having a light-transmissible flame image thereon, and a rear lighting assembly, the rear lighting assembly being arranged to project light through the rear screen towards a front of the apparatus.

11. An electric fire apparatus as claimed in claim 1, further comprising an at least in part reflective screen positioned at or adjacent to a rear of the ember bed base.

12. An electric fire apparatus as claimed in claim 1, wherein the mirror assembly comprises a first, rear-facing mirror which defines a rear-facing reflective surface, and a second, front-facing mirror which defines the forward-facing reflective surface, the first and second mirrors being connected to one another at an angle.

13. An electric fire apparatus as claimed in claim 12, wherein the first mirror at least in part overlaps the ember bed base in a vertical direction.

14. An electric fire apparatus as claimed in claim 1, wherein the mirror assembly comprises an arcuate mirror element at least the forward-facing reflective surface.

15. An electric fire apparatus having an improved simulated flame effect, the apparatus comprising:

an outer casing having an at least in part light-transmissible ember bed base therein;

a projection screen positioned at or adjacent to a front of and above the ember bed base; and an illumination assembly which defines a reflection chamber below the ember bed base, the illumination assembly having at least a forward-facing light-directing surface to direct light through the ember bed base onto the projection screen; and a front light channel which is at a front of the projection screen and is adapted to light-transmissibly communicate with the reflection chamber.

16. An electric fire apparatus having an improved simulated flame effect, the apparatus comprising:

an outer casing having an at least in part light-transmissible ember bed base therein;

a projection screen positioned at or adjacent to a front of the ember bed base;

a rotating spindle positioned below the ember bed base;

a light source arranged to direct light towards the rotating spindle; and a mirror assembly which defines a reflection chamber adjacent to the rotating spindle, the mirror assembly having at least a forward-facing reflective surface to direct light scattered from the rotating spindle through the ember bed base onto the projection screen; and, wherein the mirror assembly comprises a first, rear-facing mirror which defines a rear-facing reflective surface, and a second, front-facing mirror which defines the forward-facing reflective surface, the first and second mirrors being connected to one another at an angle.

* * * * *